US008826923B2

(12) United States Patent
Caulier

(10) Patent No.: US 8,826,923 B2
(45) Date of Patent: Sep. 9, 2014

(54) APPLICATOR FOR APPLYING A PRODUCT TO THE EYELASHES AND/OR THE EYEBROWS

(75) Inventor: Eric Caulier, Maignelay (FR)

(73) Assignee: L'Oreal, Paris (FR)

( * ) Notice: Subject to any disclaimer, the term of this patent is extended or adjusted under 35 U.S.C. 154(b) by 18 days.

(21) Appl. No.: 13/636,884

(22) PCT Filed: Mar. 29, 2011

(86) PCT No.: PCT/IB2011/051313
§ 371 (c)(1),
(2), (4) Date: Jan. 10, 2013

(87) PCT Pub. No.: WO2011/121526
PCT Pub. Date: Oct. 6, 2011

(65) Prior Publication Data

US 2013/0104925 A1 May 2, 2013

Related U.S. Application Data

(60) Provisional application No. 61/328,672, filed on Apr. 28, 2010.

(30) Foreign Application Priority Data

Mar. 30, 2010 (FR) ..... 10 52372

(51) Int. Cl.

| | |
|---|---|
| ***A45D 40/26*** | (2006.01) |
| ***A46B 9/02*** | (2006.01) |
| ***A46D 1/00*** | (2006.01) |
| *A46B 3/18* | (2006.01) |

(52) U.S. Cl.
CPC ..... *A45D 40/262* (2013.01); *A46B 9/021* (2013.01); *A46B 2200/106* (2013.01); *A46B 2200/1053* (2013.01); *A46B 3/18* (2013.01); *A46D 1/00* (2013.01)
USPC ..... 132/218

(58) Field of Classification Search
USPC ..... 132/218, 320, 317
See application file for complete search history.

(56) References Cited

U.S. PATENT DOCUMENTS

| | | | | |
|---|---|---|---|---|
| 7,096,936 | B1 | 8/2006 | Chastine et al. | |
| 2002/0005209 | A1 * | 1/2002 | Gueret | 132/218 |
| 2003/0084913 | A1 | 5/2003 | Gueret | |

(Continued)

FOREIGN PATENT DOCUMENTS

| | | | |
|---|---|---|---|
| FR | 2 905 243 | A1 | 3/2008 |
| FR | 2 906 116 | A1 | 3/2008 |

(Continued)

OTHER PUBLICATIONS

French Written Opinion issued in Application No. 10 52372; Dated Mar. 30, 2010 (with translation).

(Continued)

*Primary Examiner* — Rachel Steitz
(74) *Attorney, Agent, or Firm* — Oliff PLC

(57) ABSTRACT

An applicator for applying a product to the eyelashes and/or the eyebrows including: a first application member including a first untwisted core, notably at least partially or even entirely made of synthetic material, and first application elements, a second application member including a second core twisted over at least a portion of the length of the first application member and second application elements supported by the second core, the first application member having, over at least a portion of its length, a spiralling induced by the twisting of the second core on the first application member.

17 Claims, 4 Drawing Sheets

(56) References Cited

U.S. PATENT DOCUMENTS

| | | | | |
|---|---|---|---|---|
| 2008/0060669 | A1 | 3/2008 | Malvar et al. | |
| 2008/0083421 | A1 | 4/2008 | Malvar et al. | |
| 2008/0245382 | A1 | 10/2008 | Marciniak-Davoult et al. | |
| 2010/0089415 | A1 * | 4/2010 | Vandromme | 132/218 |

FOREIGN PATENT DOCUMENTS

| | | | |
|---|---|---|---|
| FR | 2 913 572 | A1 | 9/2008 |
| FR | 2 916 328 | A1 | 11/2008 |
| WO | WO 02/07559 | A2 | 1/2002 |
| WO | WO 2007/125207 | A2 | 11/2007 |

OTHER PUBLICATIONS

Written Opinion of the International Searching Authority issued in Application No. PCT/IB2011/051313; Dated Aug. 17, 2011.
International Search Report issued in Application No. PCT/IB2011/051313; Dated Aug. 17, 2011.

* cited by examiner

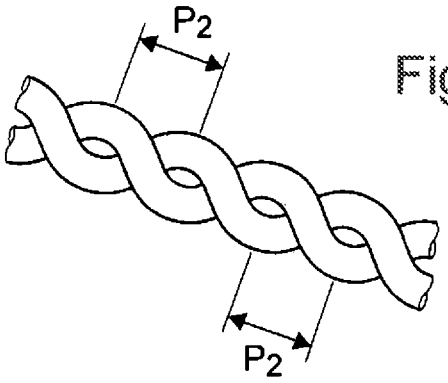
Fig.16
Fig.17
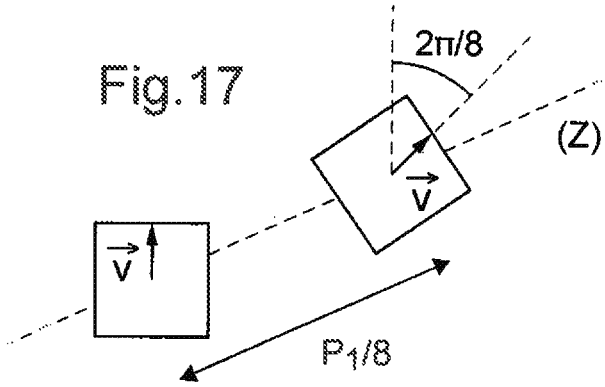

APPLICATOR FOR APPLYING A PRODUCT TO THE EYELASHES AND/OR THE EYEBROWS

The subject of the present invention is an applicator for applying a product to the eyelashes and/or the eyebrows.

BACKGROUND

Application WO 2007/125207 describes an applicator comprising a core curved like a pin onto which is threaded a plurality of kernels supporting application elements in the form of protuberances extending from the kernel. The two branches of the core are then twisted so that the application elements form helical layers. With such an applicator, the user has only one type of application element.

The patent U.S. Pat. No. 7,096,936 discloses an applicator comprising a first application member and a second application member. Each application member comprises a twisted core comprising bristles clamped between metal strands of the core and the two application members are twisted together. Such an applicator provides only one type of application element and does not provide an untwisted core presenting a spiralling induced by the twisting of the second core.

FR 2 906 116 discloses a flocked core over which a sleeve carrying bristles is placed, which compresses or redirects the flocking of the core. There is no spiralling of the flocked core when the sleeve is placed over said core.

SUMMARY OF THE INVENTION

There is a need to further refine the applicators, notably in order to allow the user to carry out various actions on the eyelashes or the eyebrows with the aid of one and the same applicator.

It is also desirable to be able to have an applicator providing new possibilities in terms of orientation and of nature of the application elements, for example in order to obtain different make-up results or to add the finishing touches to make-up.

Exemplary embodiments of the invention provide an applicator for applying a product to the eyelashes and/or the eyebrows, comprising:

- a first application member comprising a first untwisted core, notably at least partially or even entirely made of synthetic material, and first application elements,
- a second application member comprising a second core, twisted over at least a portion of the length of the first application member, and second application elements supported by the second core, the first application member having, over at least a portion of its length, a spiralling induced by the twisting of the second core on the first application member.

"First untwisted core" should be understood to be a core formed in a way other than by twisting at least two metal strands together. The first core is for example made by injection of material.

The first core is for example made of a thermoplastic, which may or may not be elastomer. It may also be an elastomer other than thermoplastic or a cast resin.

The first core may be constituted by a single strand.

The twisting may have a pitch less than 2 mm and the spiralling may have a pitch greater than twice the pitch of the twisting, better three times, even better four times.

The invention makes it possible to have an applicator comprising a plurality of application elements consisting of the first and second application elements, the latter being able, because of the twisting of the second application member onto the first application member, to be arranged in very diverse configurations. All or some of the application elements can be arranged in helical layers about the longitudinal axis of the applicator.

The twisting of the second core on the first application member may induce a spiralling of the first core.

Moreover, because of the twisting of the second application member onto the first application member, the invention make it possible to obtain a complex shape for the first application member while using a mould of relatively simple geometry in order to produce the first application member.

The second application member has, because of its twisting onto the first application member, at least a portion which extends along the first and of which the longitudinal axis is not rectilinear, preferably being substantially helical.

The second core may comprise at least one metal strand. The second core comprises for example two metal strands twisted together over at least a portion of their length. The second application elements may comprise bristles clamped between the metal strands thus twisted, as is the case with a large proportion of the mascara brushes currently on the market.

The second application member may thus be produced by applying the current widespread techniques for manufacturing conventional mascara brushes with a twisted core, with different sorts of bristles and different operations for forming the bristles.

The bristles may for example be formed by at least two different categories of bristles, the categories differing for example in the diameter of the bristles, the shape of their cross section, the material of which they are made or else their individual length measured between their free end and the second core.

An applicator according to the invention may simultaneously have fitted bristles and moulded teeth as application elements and allow the user to benefit from the advantages specific to the use of bristles and teeth.

The bristles are for example chosen for their capacity to be loaded with product, and being for example numerous and thin, or even flocked, while the teeth may be chosen for their ability to separate the eyelashes because of a greater stiffness than the bristles.

The presence of the second application member, notably when the latter comprises bristles as application elements, may make it possible to compensate for a relatively small number of application elements of the first application member. Generally, for a mascara brush with a conventional core, it is sometimes sought to reduce the "spiral effect", that is to say the tendency of the bristles to organize themselves in helical layers. The spiralling associated with the presence of the second application member may cause a helical layering of the first application elements, but the presence of these second application elements makes it possible to benefit from a greater abundance of application elements and notably to have application elements between the helical layers.

A metal strand of the second core has for example a diameter of between 0.3 and 1 mm. It may be preferable to use a small diameter of strand, of circular or non-circular section, in order to reduce the bulk of the core of the second application member and make the operation of twisting it onto the first application member easier. The second core is for example made of stainless steel.

The second application member may also comprise a sheath of synthetic material, coating a structural metal strand, and the second application elements may in this variant be supported by the sheath, being for example teeth moulded with the sheath. It may then be worthwhile to use, in order to produce the teeth of the second application member, a thermoplastic different from that used for producing the application elements of the first application member in order to have simultaneously on the applicator some relatively rigid application elements and other more flexible ones.

The first application elements may project relative to the first core.

The first application elements may comprise teeth moulded in a single piece with the first core. As a variant, the first application elements are overmoulded onto the first core or otherwise attached thereto, which allows use of a different material for producing the teeth.

The second application member may be totally outside the first application member, that is to say that the second core is always outside the first core.

As a variant, the second core extends over a portion of its length inside the first core, comprising for example a branch engaged through the first application member.

During manufacture, the second core may be folded on itself, forming two branches each extending along the first core, both outside the latter or not. The second application elements may be present on each of the branches. As a variant, only one branch supports, over all or some of its length, the second application elements, the other branch being able to be outside or not outside the first core.

Before twisting of the second application member onto the first application member, the first core may be arranged at least partially between the two branches of the second core. As a variant, before the said twisting, one of the branches of the second core extends over at least a portion of its length inside the first core.

The degree of spiralling of the first core is for example between 3 and 10 turns, notably between 5 and 8 turns. "Spiralling of the first core" should be understood to be a rotation of the cross section of the first core about its longitudinal axis, which may be rectilinear or curved. The degree of spiralling designates the angle by which the section has turned.

The number of first application elements may be between 2 and 220. The height of the first application elements may be between 0.5 and 8 mm, preferably being equal to 4 mm.

The first application member may comprise four rows of first application elements and the second application member may extend, over at least a portion of its length, between two adjacent rows of first application elements.

As a variant, the first application member may comprise a different number of rows of first application elements, for example two or three rows, preferably an even number of rows.

Within a row of first application elements, the bases of the first application elements are in line or offset in a zigzag or arranged otherwise, with a spacing which may or may not be constant.

The second application member may be held onto the first application member only by clamping the second core onto the first application member or, as a variant, by bonding, welding or with the aid of fitted holding means.

The two branches of the second core may be twisted together at their free end, the twisted ends being fixed in the same hole of the stem and holding the first application member.

As a variant, the free end of each branch is fixed in the stem separately from the free end of the other branch.

As a further variant, the first core comprises an extension fixed in the stem with the free ends of the branches of the second core.

Other exemplary embodiments of the invention provide a packaging and application device comprising:

an applicator as defined above, and a cosmetic product to be applied to the eyelashes or the eyebrows, notably mascara.

The product may be contained in a receptacle to which the applicator is fixed. This receptacle is preferably furnished with a wiping member for wiping the stem and the two application members. The receptacle may comprise a threaded neck onto which the applicator is screwed. The wiping member may be fixed in this neck.

Other exemplary embodiments of the invention provide a method for manufacturing an applicator as defined above, the method comprising the steps consisting in:

arranging at least a portion of the core of the second application member along at least a portion of the first application member, twisting the core of the second application member onto the first application member, so as to induce a spiralling of the core of the first application member.

The second application member may be twisted onto the first application member so that the first core has at least one spiralled portion with a right-hand pitch when moving towards the distal end. As a variant, the second application member is spiralled onto the first application member so that the first core has at least one portion with a left-hand pitch. As a further variant, the twisting of the second core takes place in two different directions on two distinct portions of the first application member so that the first core comprises at least one portion spiralled with a right-hand pitch and at least one portion spiralled with a left-hand pitch.

The method may comprise the step in which the second core is bent like a pin before it is twisted onto the first application member. In this case, the two branches of the second core may be twisted around the first application member.

One of the branches may also be at least partly inserted through the core of the first application member before the other branch is twisted onto the first application member.

The second core may comprise two metal strands twisted together supporting bristles forming all or part of the second application elements. The bristles may extend all around the first core. The bristles may or may not undergo any appropriate treatment, for example an operation of forming the enveloping surface of the second application member, for example by machining, before the second core is arranged on the first application member and it is twisted onto the latter. It is possible for example to shorten the length of the bristles on certain portions of the second application member so that, for example, in the applicator finally obtained, the bristles are shorter in the distal portion of the applicator.

It is also possible to have the bristles undergo heat treatments, fusion of the ends, abrasion treatments or mechanical impacts, for example in order to form forks or bends.

The bristles may be shaved on the side of the second application member designed to be pressed against the first application member in order to allow the second core to be as close as possible to the first application member.

The first application member may, if necessary, be produced with, on its outer surface, one or more longitudinal grooves making it easier to position the second application member on the first application member before twisting. The core of the second application member is for example received in two longitudinal grooves of the core of the first application member before the second application member is twisted onto the first.

The twisting can take place when cold, the spiralling of the first core then being able to accompany the twisting operation by virtue of the ability of the first core to be deformed when cold.

The method may also comprise the step in which the applicator obtained after twisting is curved about at least one axis other than the longitudinal axis of the first application member, for example an axis perpendicular to the latter, so as, for example, to obtain a longitudinal axis, for the application head formed by the two application members, which is curvilinear and/or which forms a non-zero angle with the longitudinal axis of the stem that supports this assembly.

BRIEF DESCRIPTION OF THE DRAWINGS

The invention will be better understood on reading the following description of nonlimiting exemplary embodiments of the latter, and on examining the appended drawing in which:

FIG. 16 shows the pitch in case of twisting, and FIG. 17 shows the pitch in case of spiralling.

DETAILED DESCRIPTION

Figure 1:
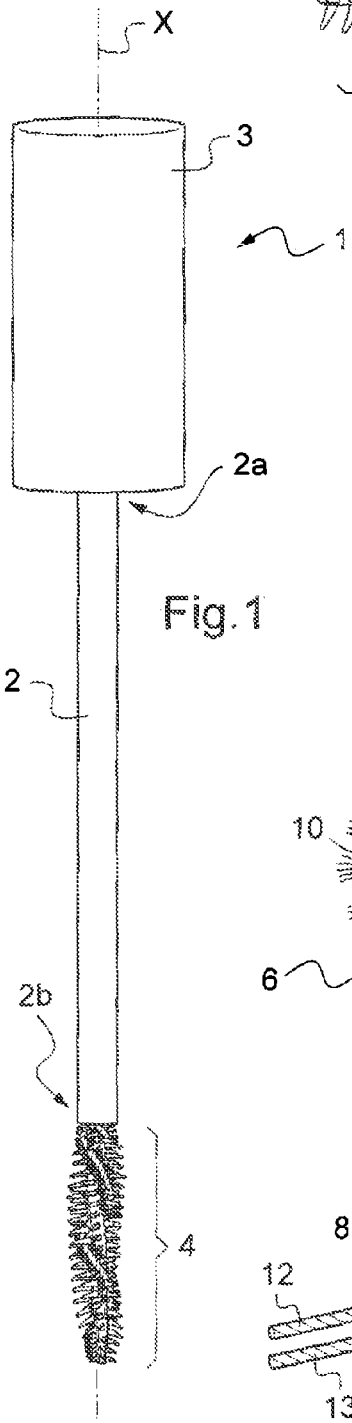
FIG. 1 represents, in perspective and in a schematic manner, an applicator according to one exemplary embodiment of the invention.

FIG. 1 shows an applicator 1 according to a first embodiment of the invention. This applicator 1 comprises a stem 2 which supports an application head 4 and which can be made of plastic and extend, as illustrated, in a substantially rectilinear manner along an axis X. As a variant, the stem 2 may extend along a curvilinear longitudinal axis.

The stem 2 is connected at a first end 2*a* to a gripping member 3. The gripping member 3 is for example configured to be put in place on a receptacle, not shown, containing for example mascara, so as to close it in a sealed manner. The gripping member may comprise a mounting skirt arranged to be fixed to the receptacle, for example to be screwed onto a neck of the receptacle. The neck of the receptacle may support a member for wiping the stem 2 of the application head. The stem 2 may have a circular cross section with or without shrinkage at its portion placed opposite the wiping member.

The stem 2 is connected, at a second end 2*b* opposite to the first end 2*a*, to the application head 4.

The application head 4 may, as shown in FIG. 1, extend along a rectilinear longitudinal axis, identical to the axis X of the stem. In variants not shown, the application head 4 extends along a longitudinal axis extending obliquely relative to the axis X of the stem 2. The application head 4 may also extend along a curvilinear longitudinal axis.

The application head 4, according to the invention, comprises a first application member 5 and a second application member 6.

Figure 2:
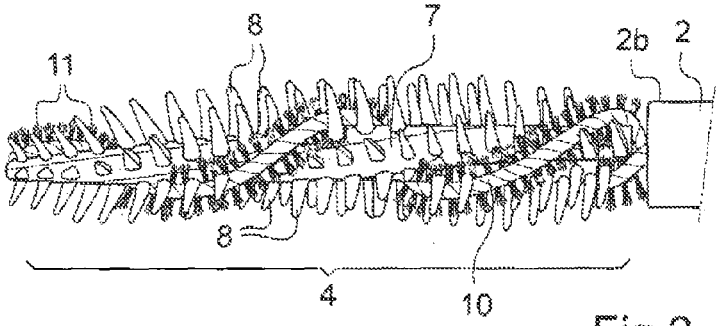
FIG. 2 represents the application head of the applicator of FIG. 1, FIGS. 3*a* and 3*b* represent examples of a second application member, before twisting onto the first application member.

As shown in FIG. 2, the second application member 6 is at least partly twisted over at least a portion of the first application member 5, this portion then having a spiralling induced by the presence of the second application member 6.

The first application member 4 comprises a core 7 injected for example with elastomeric, thermoplastic material, for example styrene ethylene butadiene styrene (SEBS) or an elastomer polyester such as HYTREL®.

The portion of the core 7 onto which the second application member is twisted is spiralled, having for example a degree of spiralling of between 3 and 10°. The core 7 is for example spiralled in the clockwise direction or in the anticlockwise direction, when looking at the application head along its longitudinal axis, facing the distal end of the application head, and when moving away from this end.

FIG. 16 shows a core made of two strands that are twisted together and each form a helix.

The pitch $P_2$ of the twisting is measured along the axis of the core between two consecutive turns that have the same coordinates in a plane perpendicular to the axis of the core, and that belong to the respective strands. In other words, the pitch $P_2$ is the axial offset between the two strands. FIG. 17 is a schematic view of a core subjected to spiralling. The spiralling induces a rotation of the cross-section. The core extends along a longitudinal axis Z. The core has for example a square cross-section. A particular vector $\vec{v}$ that is for instance parallel to two sides of the core in cross section is shown on FIG. 17. The pitch $P_1$ of the spiralling is the axial distance for a complete turn of the vector $\vec{v}$ around the center of the cross-section. For example, when the vector $\vec{v}$ of two cross sections of the core at different places along the axis Z has rotated by an angle that is 2Π/8, the distance along the longitudinal axis Z of the core between said different places is $P_1/8$. The above-mentioned exemplary definition of "pitch of spiralling" is valid regardless the shape of the cross section of the core.

As shown in FIG. 2, the first application member 4 comprises a plurality of first application elements 8 which can be made in a single piece with the core 7 by moulding in the same material as the core 7 or in a different material, in this case for example being overmoulded onto the core 7.

FIGS. 4, 5 and 7 to 10 show examples of application heads 4 before the second application member 6 is twisted onto the first application member 5.

In these examples, the first application elements 8 are initially arranged in rows distributed uniformly around the core 7 but, in variants, the first application elements are arranged otherwise. Within each row, the spacing between the application elements may be constant. The application elements may also be grouped in pairs.

Two adjacent rows of application elements of the first application member may or may not have a different pitch along the longitudinal axis of the application head, the pitch designating the spacing between two consecutive application elements in a row. As a further variant, the pitch may vary along a row. Each row may comprise one and the same number of application elements or, as a variant, a different number of application elements. Within one or more rows, the bases of the application elements may be aligned or arranged in a zigzag.

The bristles of one and the same row may be of different shape. In combination with or independently of the foregoing, the shape of the bristles may differ from each row to the next.

It is also possible for the application elements of the first application member not to be arranged in rows.

The first core may have a circular or other cross section, for example cruciform, polygonal or elliptical.

In the examples illustrated, the first application elements 8 have a constant height but, in variants not shown, the height of the application elements 8 may vary, monotonically or not, as you move along the first core 7.

In the examples of FIGS. 3 to 8, the first application elements 8 are arranged in four rows around the first core 7, two adjacent rows forming an angle of 90° between them. The first core 7 may have a cruciform section as illustrated.

Figure 9:
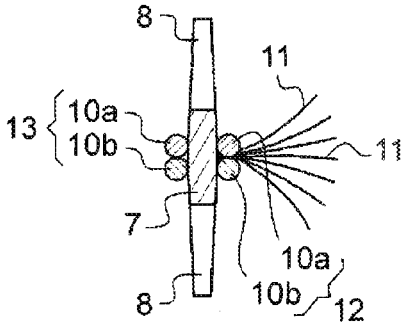
Figure 10:
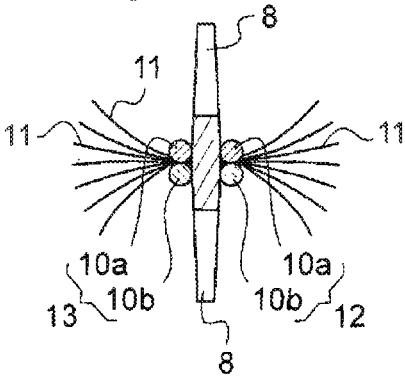

As a variant, as shown in FIGS. 9 and 10, the first application elements 8 are arranged in two diametrically opposite rows on the first core 7.

The invention is not limited to a particular number of rows of first application elements 8.

As shown in FIGS. 2 to 10, the second application member 6 may comprise a second core 10 which may consist of two metal strands 10*a*, 10*b* twisted together over the whole of their length.

In another variant, the two metal strands 10*a*, 10*b* are twisted together only over a portion of their length. Each metal strand has for example a diameter of between 0.3 and 1 mm. The two strands 10*a*, 10*b* may originate from one and the same metal wire, for example made of stainless steel, folded on itself.

As shown, the second core 10 supports second application elements 11 which, in the examples of FIGS. 2 to 10, are bristles clamped between the strands 10*a*, 10*b*. The bristles are for example made of synthetic or natural material, for example of polyamide or of Hytrel®.

The second application elements 11, notably the bristles, may be supported by the second core 10 only over a portion of its length. As a variant, the second application member 6 comprises second application elements 11 over the whole length of the second core 10. The conventional methods for manufacturing mascara brushes with a twisted core may be used to produce the second application member.

Figure 6:
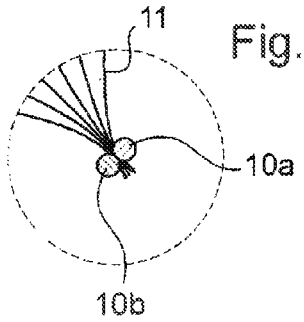
FIG. 6 is a view in cross section of an example of a second application member.

As can be seen in FIG. 6, which represents in section the second application member 6 in isolation before twisting onto the first application member 5, the bristles 11 may be treated, for example with a cutting tool, so that they do not extend evenly around the second core 10. In the example shown, a portion of the bristles has been shaved, and the side thus shaved faces the first application member 5 once the application head 4 has been produced.

Figure 3A:
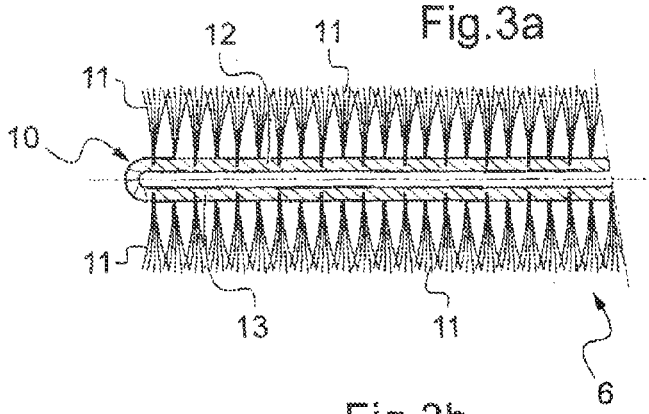
Figure 3B:
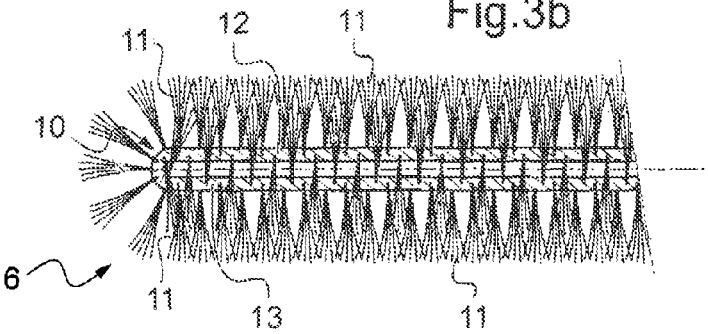
Figure 4:
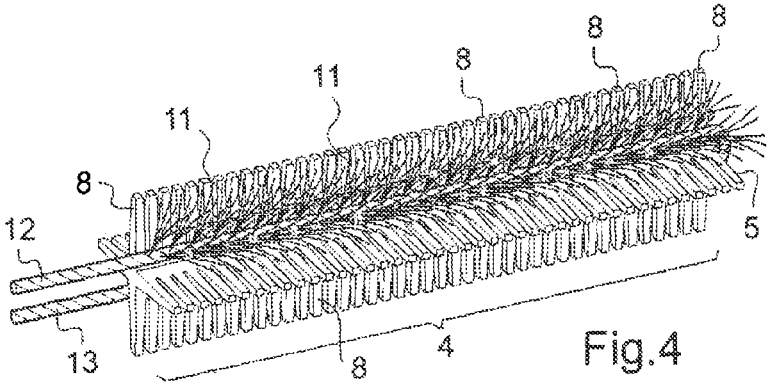
FIG. 4 represents the second application member of FIG. 3*a* in place on the first application member, before twisting.
Figure 5:
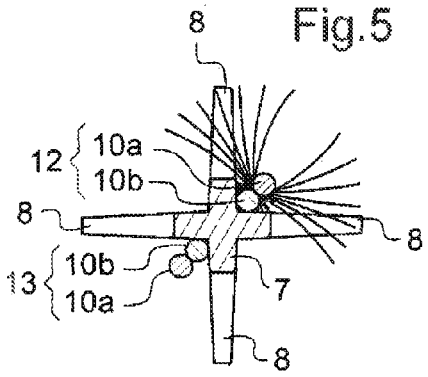
FIGS. 5, 7, 8, 9, 10 are views in cross section of examples of applicators according to the invention, before twisting.

As can be seen in FIGS. 3*a*, 3*b* and 4, the second core 10 may be folded, for example substantially in its middle, like a pin, so as to define two branches 12 and 13. Only the branch 12 may support the second application elements, the branch 13 then having none, as in the example of FIG. 5.

Figure 7:
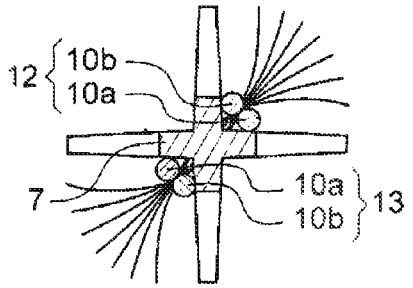

As a variant, and as shown for example in FIG. 7, the second application elements 11 are supported by each of the branches 12 and 13 of the core 10.

In the example of FIG. 3*b*, the two branches 12 and 13 are formed by a folded brush which supports bristles all around its core.

The second application member 6 is for example outside the first application member 5, as shown in FIGS. 4, 5, 7, 9 and 10. In these examples, the second core 10 is arranged on the outside relative to the first core 7. As a variant, a portion of the second core 10 may extend inside the first application member 5.

Figure 8:
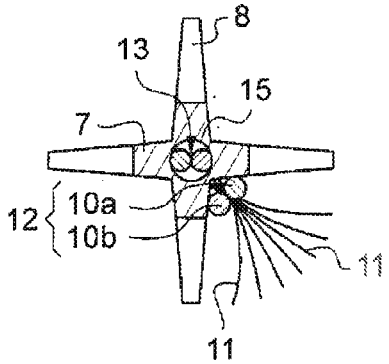

In the example of FIG. 8, the branch 13 of the second application member is arranged over at least a portion of its length inside a cavity 15 provided within the first core 7, for example centrally. The cavity 15 is for example produced by moulding. Preferably, the branch 13 engaged in the cavity supports no application elements so as not to hamper its fitting.

As shown in FIG. 4, after the second application member 6 has been fitted on the first application member 5, and before the twisting operation, each of the branches 12 and 13 of the second core 10 may be arranged between two adjacent rows of first application elements 8. The two branches 12 and 13 of the second application member 6 are then twisted, which causes the spiralling of the first core 7, as described above.

The twisting of the second application member 6 onto the first application member 5 may not modify the shape of the first application elements 11, which may remain rectilinear, for example. As a variant, the twisting may modify the shape of at least some of the application elements 11, for example by laying them onto the first core 7 because of a contact with the second application member.

With reference to FIGS. 11 to 15, an applicator 1 according to another exemplary embodiment of the invention will now be described.

This applicator 1 differs from those described with reference to FIGS. 1 to 10 in that the second application member 6 does not have a second twisted core 10 clamping bristles, but a second core 20 produced by moulding or extrusion of a sheath 21 of synthetic material onto a metal wire 22 which serves as a structural element for it.

Figure 11:
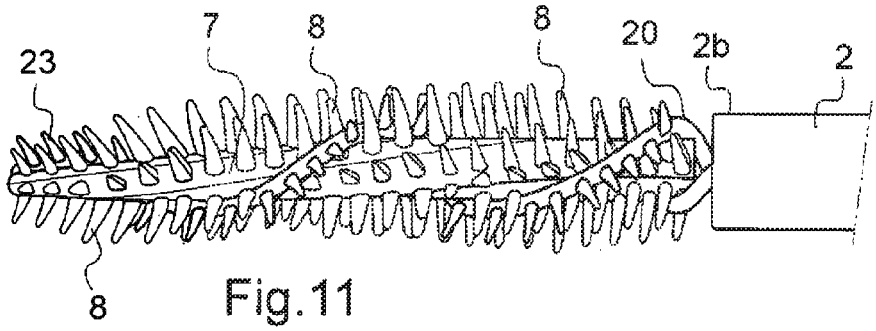
FIG. 11 is a view similar to FIG. 2 of an application head of an applicator according to another exemplary embodiment of the invention.

As can be seen in FIG. 11, this second core 10 supports, over all or part of its length, second application elements 23 which may be teeth. These teeth may be made by moulding in a single piece with the synthetic sheath 21 or, as a variant, be overmoulded onto this sheath 21, in the same or different material. The teeth 23 may have the same size when moving along the second core 20. As a variant, at least one of their dimensions, for example their height, varies monotonically or not along the second core 20.

The teeth 23 supported by the second core 20 may have the same dimensions as the teeth 8 supported by the first core 7. As a variant, the teeth 23 are bigger or smaller than the teeth 8. As a further variant, the application head 4 comprises a portion on which the teeth 23 are bigger than the teeth 8 and a portion on which the teeth 23 are smaller than the teeth 8. The section of the structural metal wire 22 may be circular or polygonal, for example rectangular or another shape.

Similarly to what has been described above, during the production of the application head 4, the second core 20 may be folded, for example substantially in its middle, like a pin, then defining two branches 24 and 25. The second core 20 may also be moulded onto a metal wire already shaped like a pin.

Figure 12:
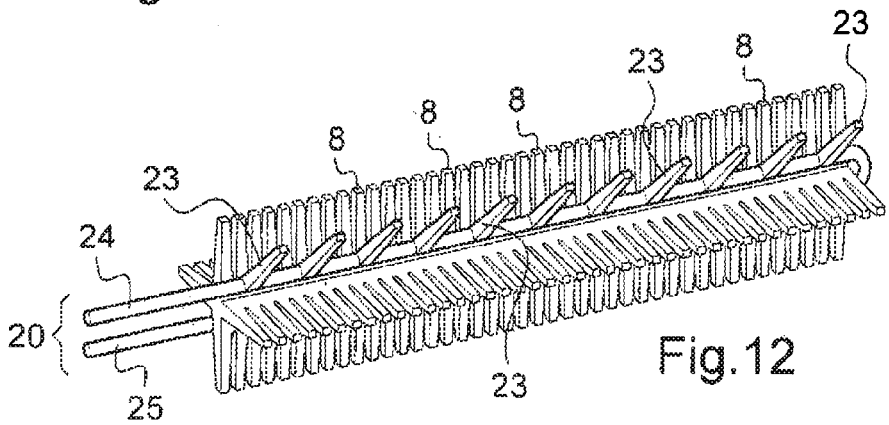
FIG. 12 is a view similar to FIG. 4 representing a second application member in place on the first application member before twisting.

FIG. 12 shows the application head 4 before twisting of the branches 24 and 25 onto the first application member.

The second application member 6 may be fitted on the first application member 5 so that each branch 24 and 25 of the second core 20 is arranged between two adjacent rows of first application elements 8.

The two branches 24 and 25 of the second application member 6 may then be twisted so as to confer a spiral on the first core 7. This gives helical layers of application elements consisting of the first and second application elements. The first and second application elements may be made in one and the same material or in different materials, so as to have different properties, for example in terms of hardness and/or of surface appearance.

Figure 13:
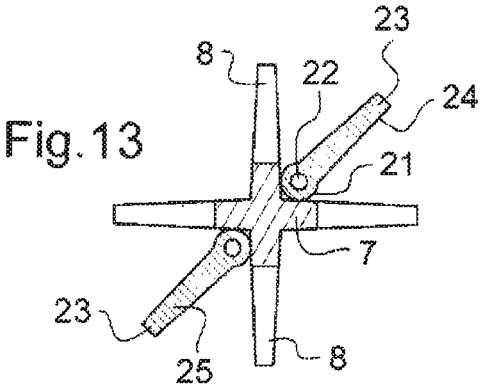
FIGS. 13 to 15 are views in cross section of other examples of applicators.
Figure 14:
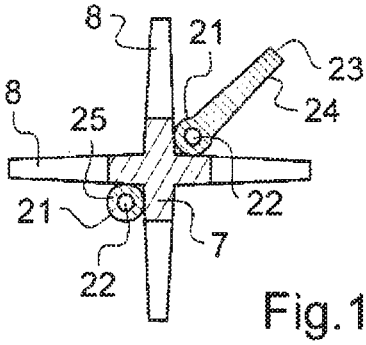
Figure 15:
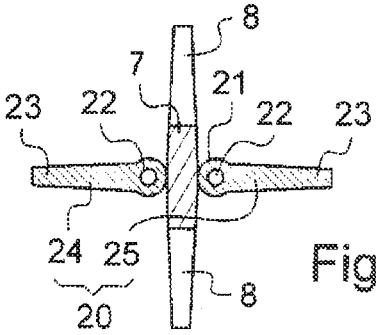

The application elements 23 may be supported only by the branch 24, as shown in FIG. 14. As a variant, each branch 24 and 25 of the second core 20 supports teeth 23, as shown in FIG. 13.

When a branch supports no teeth, the structural wire may be covered by the sheath.

In another variant, the second application member comprises a metal wire folded on itself, of which only one of the branches is coated with the sheath and teeth and of which the other branch is inserted bare into the core of the first application member or is outside this core.

The invention is not limited to the examples that have just been described.

For example, it is possible to combine in a general manner all types of first application members made by moulding of material with all types of second application members consisting of mascara brushes which are twisted onto the first application member.

The first application member may be fitted onto the stem or moulded in a single piece with the latter. The second application member may or may not be fixed in the stem.

As a variant, the stem may retract inside the receptacle by virtue of return means and remain secured to the receptacle on application of the product.

The receptacle may be furnished with any type of member for wiping the stem and the application head, which member may or may not be adjustable, with an elastomer lip, which may or may not be corrugated, which may or may not be split.

The application head may be connected to the stem via a flexible portion that is elastically deformable.

The applicator may comprise a source of vibration, as necessary, and/or be rotary and/or heating. In particular, the second application member may be twisted onto a first heating application member.

The first and second application members may be of different colours.

The expression "comprising a" should be understood as being synonymous with "comprising at least one" unless the contrary is specified.

The invention claimed is:

1. An applicator for applying a product to eyelashes and/or eyebrows, the applicator comprising:

a first application member comprising a first untwisted core that is at least partially made of synthetic material, and first application elements, a second application member comprising a second core twisted over at least a portion of a length of the first application member and second application elements supported by the second core, the first application member having, over at least a portion of its length, a spiralling induced by the twisting of the second core on the first application member.

2. The applicator according to claim 1, the second core comprising at least one metal strand.

3. The applicator according to claim 2, the second core comprising two metal strands twisted together over at least a portion of their length, the second application elements comprising bristles clamped between the metal strands twisted together.

4. The applicator according to claim 2, the second application member comprising a sheath made of synthetic material coating a structural metal strand and the second application elements being supported by the sheath.

5. The applicator according to claim 1, the first application elements comprising teeth moulded in a single piece with the first core.

6. The applicator according to claim 1, the second application member being totally outside the first application member.

7. The applicator according to claim 1, the second core extending, over a portion of its length, inside the first core.

8. The applicator according to claim 1, the second core being folded on itself and forming two branches each extending along the first application member.

9. The applicator according to claim 8, the second application elements being arranged on each of the branches.

10. The applicator according to claim 1, the degree of spiralling of the first core being from 3 and 10 turns.

11. The applicator according to claim 1, the first application member comprising four rows of first application elements and the second application member extending, over at least a portion of its length, between two adjacent rows of first application elements.

12. The applicator according to claim 1, the first untwisted core being constituted by a single strand.

13. The applicator according to claim 1, the spiralling having a pitch greater than twice a pitch.

14. A packaging and application device comprising:

an applicator according to claim 1, and a cosmetic product to be applied to the eyelashes or the eyebrows, the cosmetic product being mascara.

15. A method for manufacturing an applicator as defined in claim 1, comprising:

arranging at least a portion of the core of the second application member along at least a portion of the first application member, twisting the core of the second application member onto the first application member so as to induce a spiralling of the core of the first application member.

16. The method according to claim 15, in which:

the second core is folded like a pin before being twisted onto the first application member.

17. The method according to claim 15, the second core comprising two metal strands twisted together and supporting bristles forming all or part of the second application elements, a method in which the bristles are subjected to an operation of forming an enveloping surface of the second application member before the second core is arranged on the first application member and is twisted onto the latter.

* * * * *